United States Patent [19]

Gueret

[11] Patent Number: 4,889,228

[45] Date of Patent: Dec. 26, 1989

[54] SINGLE-USE MAKEUP SET

[75] Inventor: Jean-Louis Gueret, Paris, France

[73] Assignee: L'Oreal, Paris, France

[21] Appl. No.: 291,293

[22] Filed: Dec. 28, 1988

[30] Foreign Application Priority Data

Dec. 29, 1987 [FR] France ..... 87 18295

[51] Int. Cl.[4] ..... A45D 40/00; A45D 40/26

[52] U.S. Cl. ..... 206/209; 206/229; 206/823; 206/581; 401/122; 401/118; 401/129; 401/132

[58] Field of Search ..... 401/118, 129, 132, 122, 401/127, 128; 206/209, 229, 823, 581

[56] References Cited

U.S. PATENT DOCUMENTS

| | | | |
|---|---|---|---|
| 2,454,718 | 11/1948 | Russo | 206/823 X |
| 2,547,779 | 4/1951 | Renyck | 401/118 |
| 4,403,624 | 9/1983 | Montgomery | 401/129 X |
| 4,540,007 | 9/1985 | Carracoy | 401/132 X |
| 4,784,505 | 11/1988 | Dahm | 401/129 X |

FOREIGN PATENT DOCUMENTS

| | | | |
|---|---|---|---|
| 0078356 | 5/1983 | European Pat. Off. . | |
| 0171983 | 2/1986 | European Pat. Off. . | |
| 685054 | 12/1952 | United Kingdom . | |
| 2082553 | 3/1982 | United Kingdom | 401/129 |
| 2126890 | 4/1984 | United Kingdom . | |
| 2159699 | 12/1985 | United Kingdom | 401/129 |
| 2178647 | 2/1987 | United Kingdom | 401/129 |

OTHER PUBLICATIONS

French Search Report, 9/30/88.

*Primary Examiner*—William Price

*Attorney, Agent, or Firm*—Cushman, Darby & Cushman

[57] ABSTRACT

A makeup set (1) includes a package, formed of two sheets of plastic material (*2a, 2b*) partially welded together, in which package and applicator is disposed, comprising an element (8) for holding in the hand and a distributor device (9) in a chamber prefilled with the composition to be tested. The package has two separate portions (13, 14): a first portion (13) capable of being opened, the two sheets (*2a, 2b*) being joined by a perforated welded bead (6), and a second portion (14) in which the sheets (*2a, 2b*) are welded. A constriction zone (7) is formed in the plastic sheets (*2a, 2b*) at the level of the welded portion (14) in order to assure the wiping of the distributor device (9) when it is removed from the package. This makeup set may be presented in the form of small plates (15) on which a plurality of packages (1) disposed side by side are disposed together.

18 Claims, 2 Drawing Sheets

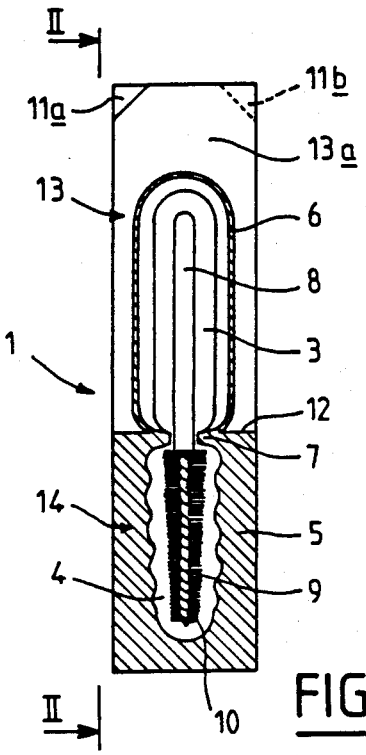
FIG. 1
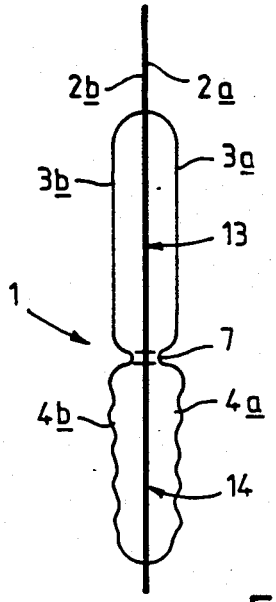
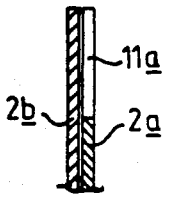
FIG. 2A
FIG. 2
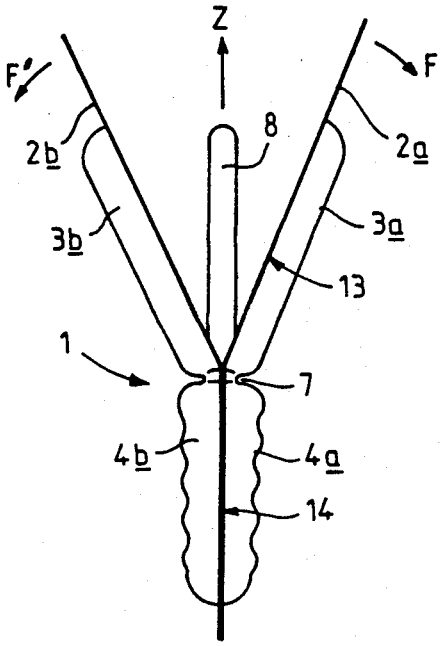
FIG. 3
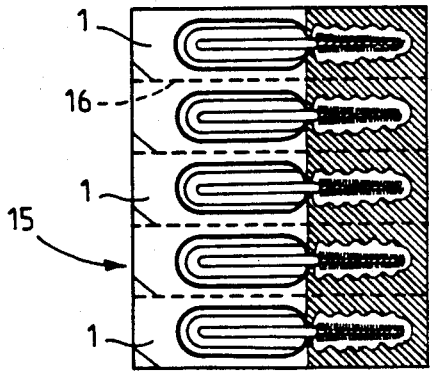
FIG. 4

SINGLE-USE MAKEUP SET

FIELD OF THE INVENTION

The present invention relates to a makeup set provided for being used a single time and then discarded after use. Such a set is intended in particular for making up the eyelashes with an eyelash reinforcing product, also known as mascara, or for cosmetic treatment of the nails using a varnish, or making up the lips, eyelids and the face in general.

BACKGROUND OF THE INVENTION

A conventional makeup applicator includes a container that contains the product and a removable cap intended to close the container; the cap comprises an element making it possible to manipulate a distributor device carried at the end of a rod integrally attached to the cap. In the closed position of the container, the rod and the distributor device with which it is associated dip into the container. When the rod is withdrawn from the container, a certain quantity of makeup product that one wishes to apply to the surface to be made up is picked up by the distributor device. In the case of a nail polish applicator, the distributor device is a brush; in the case of an applicator for the lips, the distributor device may comprise a zone of the associated rod on which a tuft of fibers has been provided; in the case of an applicator for making up the eyelids, the distributor device may be a pad of flexible plastic foam at the end of the associated rod; and in the case of face makeup with a makeup base or cream, the distributor device may be a flexible spatula fixed at the end of the associated rod.

In the case of eyelash makeup, the distributor device is preferably a brush, which is advantageously cylindrical or conical; in order to eliminate the excess makeup product picked up on the brush, a wiper device is incorporated into the container, comprising a single lip or double wiper allowing only the quantity of cosmetic product necessary for good makeup to remain on the brush. The importance of this type of wiper is also apparent for applicators intended for other types of makeup.

As is well known, customers very often wish to try a makup product by testing it directly on the surface (for example, eyelids, face, eyelashes, nails) that is to receive it. Until now, these tests have been done using makeup sets identical to those sold and have been usable in succession by a plurality of customers. However, for hygienic reasons and more particularly taking into account the risks of transmission of serious contagious diseases, it is believed to be no longer acceptable for public tests to be made by using the same makeup set for several persons. Accordingly, research has been directed to developing makeup sets of reduced size capable of being used for a single test and then discarded; naturally in such a case, it is very desirable for these makeup sets to have a moderate cost.

In this context, it has already been proposed that makeup sets be made that are smaller but of the same structure as the conventional makeup sets. Hence the side wall of the container and the threads intended for cooperating with the threads of the cap are produced by molding; the base of the container is molded separately, and the side wall is affixed to the base; then, the wiper device is placed at the top of the container. These makeup sets of reduced size nevertheless have a certain number of disadvantages: In the first place since height of the container is only very little greater than the height of the distributor device that closes it, the container must be filled completely with the cosmetic product, so that the distributor device will be impregnated with the product over its entire length; however, in that case, in the course of manufacture, inserting the applicator device into the fully filled container often causes spilling of the cosmetic product from the container. In the second place, these test sets, made like the conventional sets, with the same number of parts and by the same method, have a high cost that is quite incompatible with the fact that they must be discarded after the test.

It has also been proposed to form a simpler container of different structure and obtained by injection or extrusion blow molding; thus it is possible to obtain a container made in a single piece that in its upper portion has a wiper device comprising a constricted portion of the side wall of the container. To reduce the cost, the reservoir is not filled with the cosmetic product, and a distributor device previously oversaturated with cosmetic product is used, since the container no longer plays any role except to protect the pre-filled distributor device. However, a makeup set of this type has one major disadvantage: At the time of manufacture, the applicator is inserted into the container and the applicator is wiped by sliding past the constriction and then is no longer oversaturated with the product; as a result, at the time of the test, the distributor, which undergoes a second wiping when it is removed from the container, is not sufficiently filled with cosmetic product to make a satisfactory test. If one wishes to overcome this disadvantage by recourse to the technique of filling the container with product, then the cost becomes higher, and there is once again the disadvantage of the risk of spilling at the moment when the distributor device inserted into the filled container.

OBJECT AND SUMMARY OF THE INVENTION

The present invention makes it possible to overcome the above disadvantages. To this end, it proposes making single-dose makeup sets comprising a distributor device pre-filled with the product, about which a package is formed that includes a wiper constriction. This package is made by welding and shaping of two sheets, between which the distributor device, pre-filled with cosmetic product, has previously been placed. The constriction, which comprises the wiper device, is formed upon shaping inside these sheets; complementarily, it has a function of positioning the rod associated with the distributor, such that the distributor is held inside the volume that it fills and will not damage the plastic that defines this volume during handling of the makeup set. As a result, it is henceforth possible not to fill the volume shaped around the distributor with the product, since the distributor is not wiped except at the moment the applicator leaves the package and hence can be oversaturated when put in place, prior to the shaping of the package from the two sheets; the product deposited on the distributor is not spread over the walls that surround the distributor, since the applicator is held in position by the wiper constriction. Moreover, in addition to the advantage of a simple structure, making it possible to avoid prior filling of a container, there is also the advantage of a very reduced cost.

Finally, the makeup set according to the present invention has the complementary advantage that it can be manufactured in a plurality of examples grouped side by side on one and the same small plate, with perforated lines of separation making it possible to separate the various test sets from the small plate. One plate can include a plurality of identical test sets, or an assortment of test sets corresponding to different makeup compositions, within the line of products tested, for the eyelashes, the skin, the eyelids, the lips or the nails. A single-dose makeup assortment of this kind can be used for advertising purposes as well.

Accordingly, the subject of the present invention is the novel industrial product comprising a makeup set, in particular for the eyelashes or the nails, including an applicator in a package, the applicator comprising an element for being held in the hand and a device for distributing the composition to be tested, characterized in that the distributor device is filled with the composition to be tested and is packaged between two sheets partially welded to one another, with a constricting zone formed between the sheets at a level located between the element for being held in the hand and the distributor device of the applicator.

The sheets comprising the package may be sheets of plastic or metal material that are thermoformed or stamped; the metal sheets may be covered with plastic material.

Advantageously, the makeup set according to the present invention is characterized in that the package has two separate portions, a first portion being capable of being opened, for example by separating the sheets that form the package, and a second portion in which the two sheers are welded so as to prevent their being separated by manual action; the welded zones of the second portion define a volume where the two sheets are not welded to one another, and this volume contains the distributor device of the applicator. The first portion includes a first, non-welded zone and a second zone, at the level of which the sheets are joined to one another by a welded bead that defines a space containing the element for holding in the hand, and joined to the second portion of the package.

In a first embodiment, the welded bead that connects the sheets to one another at the level of the first portion of the package is connected to the constriction zone formed in the sheets of the package.

In a second exemplary embodiment, the first portion of the makeup set, in the space containing the element for holding in the hand, includes a bulge substantially in the form of a bubble larger in diameter than the circular constriction zone to which it is connected; this bulge is able to comprise a folding zone, preventing deformation from occurring at the level of the circular constriction zone. The welded bead then forms a recess that surrounds the bulge and connects it to the second portion at a distance from the constriction zone.

Advantageously, the first zone of the first portion of the package has at least one corner, and preferably two, where one of the two sheets is cut, to facilitate the separation of the two sheets in order to open the first portion.

The package may include a pre-weakened zone in its first portion, extending to above the constriction zone.

The pre-weakened zone may be arranged such that the two portions can be separated by twisting substantially about the axis of the element for holding in the hand. In particular, in the case where the makeup set includes a bulge substantially in the form of a bubble, as defined above, the pre-weakened zone may be created by two incisions provided on either side of the bulge.

In a first application, the makeup set according to the invention is intended for testing a mascara composition, and the distributor device is a brush, while the element for holding in the hand comprises the extension of the twisted metal wire that locks the bristles of the brush in place; the element for holding in the hand may be coated with plastic material or covered with a plastic sheath or with a sheet of retractable plastic material.

In a second application, the makeup set according to the present invention is intended for testing a nail polish composition, and includes a distributor device comprising a brush, in which the element for holding in the hand comprises the rod to which the bristles of the brush are attached.

The package of the makeup set according to the present invention may be formed by sheets comprising a polymer selected from the group comprising polyvinyl chloride, polyvinyl chloride/polyvinylidine chloride complexes, polyester/polyethylene complexes, polyvinyl chloride/polyvinyl alcohol/polyethylene complexes, and polyacrylonitrile/polyethylene complexes. Advantageously, at least one of the sheets from which the package is made is metallized or comprises a plastic-/aluminum complex.

The subject of the present invention is also a small plate on which a plurality of makeup sets are grouped such as those defined above, characterized in that the various packages of the makeup sets are disposed side by side and are separated from one another by a perforated or tearable separation line.

The subject of the invention will be better understood from the ensuing detailed description, solely by way of example and not to be understood as limiting, of various exemplary embodiments shown in the accompanying drawings.

BRIEF DESCRIPTION OF THE DRAWINGS

FIG. 1 is an elevation view of a makeup set in a first exemplary embodiment of the invention;

FIG. 2 is a profile view taken along the line II—II of the makeup set of FIG. 1;

FIG. 2A is an enlarged cross-sectional view of the top edge of FIG. 2;

FIG. 3 is a view similar to FIG. 2, except that in this figure the package is open, so that the element to be taken in the hand can be grasped;

FIG. 4 is an elevation view of a small plate grouping a plurality of makeup sets such as those shown in FIG. 1 on it;

DESCRIPTION OF THE PREFFERED EMBODIMENTS

Figure 5:
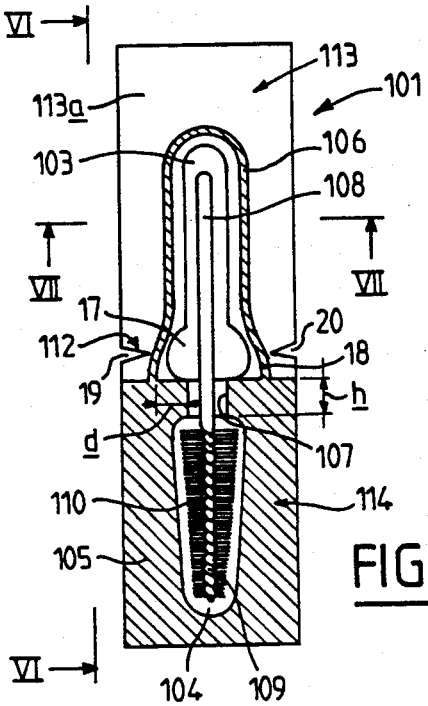
FIG. 5, similarly to FIG. 1, shows a second exemplary embodiment of the makeup set according to the invention.
Figure 6:
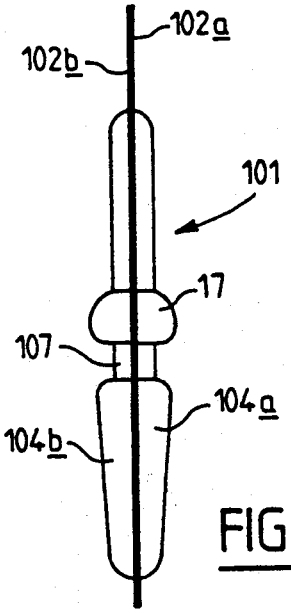
FIG. 6 is a profile view along the line VI—VI of FIG. 5.

Turning now to FIGS. 1–3, it can be seen that a makeup set 1 for single use, intended for testing a mascara composition is shown.

As shown in FIGS. 1 and 2, the closed set 1 is formed by joining two sheets of plastic material *2a, 2b* comprising a polymer selected in accordance with the formulation of the makeup product. It is understood that plastic sheets 2a, 2b must be chemically compatible with the makeup product, which is carried by the pre-filled distributor device of the set according to the invention. The material comprising these two plastic sheets 2a, 2b will also be selected in such a manner as to obtain the maximum possible impermeability, so as to reduce the exchanges of gas and possible evaporation of the solvents in the makeup product tested to a minimum, so that the test will take place satisfactorily with the product that has maintained its fluidity and its initial properties. In this example, a polyvinyl chloride/polyvinylidine chloride complex is used, and the mascara tested is a mascara in which the solvent is water.

The two sheets 2a, 2b are welded by heat or ultrasound. They may have been pre-shaped in the form of half-shells or may be thermoformed around the applicator.

The makeup set 1 has a rectangular shape, seen in plan view; it comprises two separate portions 13 and 14. The portions 13 and 14 are rectangular and adjacent; they are connected to one another parallel to a short side of the rectangle comprising the set 1. On the side opposite the portion 14, the portion 13 has a first non-welded zone 13a and a second zone, between the zone 13a and the portion 14, in which the sheets 2a, 2b are connected to one another via a welded bead 6 that can be torn by simple manual action. This welded bead 6, in the form of a U, defines a space 3 between the two sheets 2a, 2b that contain the element for holding an applicator in the hand. The distributor device of the applicator is a conical brush comprising bristles 10 locked in place in a twisted metal wire. The element 8 for holding in the hand comprises the extension of the twisted metal wire that locks the bristles 10 of the brush in place, and the extension is coated with a plastic material. As FIGS. 1 and 2 show, this element 8 for holding in the hand is accommodated in the space 3 defined by the side walls 3a, 3b, which approximately form half-cylinders having a rounded end on the side of the zone 13a.

The portions 13 and 14 ar joined to one another at the level of a constriction zone 7, which closes the space 3 in the direction of the portion 14, except for space reserved for the passage of the element 8. The constriction zone 7 is formed by pinching in the sheets 2a, 2b perpendicular to the mean plane of the sheets; the constriction zone comprises a wiper for the brush, which is packaged in the portion 14 of the makeup set 1. The welded bead 6 is attached directly to the constriction zone 7.

The portion 13a of the makeup set 1 has corners 11a, 11b on its free end that forms a short side of the set 1, and at these corners one of the sheets 2a, 2b is cut, which enables easy separation of the two sheets 2a, 2b to open the package. At the level of and on either side of the constriction zone 7, the portion 13 includes a pre-weakened line 12 intended to assure folding without effort of the sheets 2a, 2b.

In the portion 14 of the set 1, the two sheets of plastic material 2a, 2b are welded together along a wide zone 5, which seen in plan view is in the shape of a U. These welded zones between them define a volume 4 defined by the side walls 4a, 4b in the form of half-shells. This volume 4 shelters the brush, which comprises the distributor device 9 of the applicator.

The volume 4 communicates with the space 3 via the constriction zone 7, which functions as a wiper; the minimum outer diameter of the bristles of the brush are slightly greater than that of the opening defined by this constriction zone 7.

The makeup sets according to the invention may be presented singly to the user. However, FIG. 4 shows a small plate 15 formed by assembling a plurality of makeup sets 1, according to the invention side by side; each of these sets can be separated from its neighbor because of the presence of perforated lines 16 and has a structure corresponding substantially to that which has just been described with reference to FIGS. 1–3.

The makeup set 1 is used in the following manner: when the user wishes to test the mascara, one makeup set 1 need merely be detached from the small plate 15 and then the two sheets 2a, 2b comprising the package are separated by pulling them in the directions F and F' at the level of the cut corners 11a, 11b. The sheets 2a, 2b separate by rupture of the welded bead 6 up to the level of the pre-weakened line 12, so that the element 8 for holding in the hand is uncovered; the pulling apart of the two half-cylinders 3a, 3b is maintained because of the folding of the plastic material at the level of the weakening line 12. Since the pulling apart of the half-cylinders 3a, 3b is effected without effort, the risks of deterioration of the constriction zone 7 are lessened.

Now the user need merely grasp the element 8 and pull it in the direction Z to remove the applicator from the package. The distributor device 9 of the applicator is wiped in passing through the constriction zone 7 and is then impregnated with the precise quantity of mascara to be tested that is necessary and sufficient for a satisfactory test.

Turning now to FIGS. 5–8, these drawings show a second exemplary embodiment with which any deformation of the constriction zone, acting as a wiper, can be avoided.

In fact, in the case of the embodiment of FIGS. 1–4, when the two sheets 2a, 2b are pulled apart (FIG. 3), the constriction zone 7, the initial cross section of which is circular may deform and become oval in shape. As a result, when the brush 9 is removed, the filling on the brush will not be homogeneous, because of the deformation or crushing of the removal opening comprised by the zone 7.

The second exemplary embodiment of FIGS. 5–8 makes it possible to avoid such a disadvantage.

In FIGS. 5–8, elements similar to or playing a role similar to the elements already described in conjunction with FIGS. 1–4 are identified by the same reference numeral, raised by 100. These elements will not be described again below, or will be described only briefly.

As can readily be seen in FIGS. 5–8, the first portion 113 of the makeup set includes a bulge 17, substantially in the form of a bubble, comprising the joining of two half-bulges, which face one another with their concave portions and are provided in each sheet 102a, 102b. The bulge 17 has a maximum diameter greater than the diameter of the circular constriction zone 107, the length h of which is sufficient to create a cylindrical passage. The bulge 17 is connected in its lower portion, in FIGS. 5 and 6, to the constriction zone 107.

The welded bead 106 in the vicinity of the second portion 114 forms a flare 18 that surrounds the bulge 17 and rejoins the second portion 114 at a distance d from the constriction zone 107.

If the set 101 is opened in a manner similar to what is shown in FIG. 3, that is, by pulling the sheets 102a, 102b apart, then the bulge 17 creates a folding zone where the deformation takes place at the time the sheets 102a, 102*b* are pulled apart, while the constriction zone 107 does not undergo any deformation and retains its circular cross section. Hence the wiping takes place homogeneously over the brush 109 as it is removed. The opening of the makeup set may be provided with the aid of a twisting motion substantially about the axis of the element 108 for holding in the hand, with the aid of a pre-weakened zone 1!2 located in the first portion 113, in the vicinity of its junction with the second portion 114. The zone 112 is preferably created by two incisions 19, 20 provided on either side of the bulge 17 on the long sides of the set 101.

Figure 8:
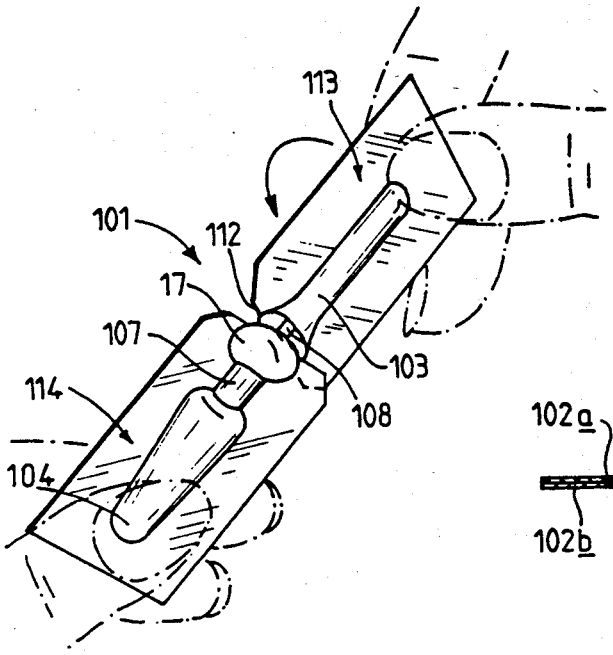
FIG. 8 is a perspective view illustrating how the set of FIG. 6 is opened.
Figure 7:
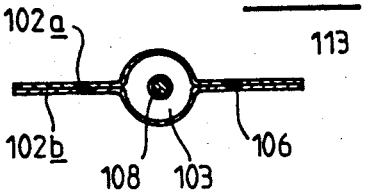
FIG. 7 is a section taken along the line VII—VII of FIG. 5.

Holding the second portion 114 in one hand and exerting a twisting action on the first portion 113 with the other hand, substantially about the axis of the element 108, as shown in FIG. 8, the rupture of the zone 112 is brought about by a shearing action, and the portion 113 can be separated from the portion 114. The element 108 for holding in the hand is then accessible, and the brush 109 can be withdrawn from its housing 104, with homogeneous wiping at the circular constriction zone 107, which has not been deformed.

It is clear that this manner of separation by shearing action by twisting can also be attained in the embodiment of FIGS. 1–4.

Regardless of the embodiment, the two half-shells *2a, 2b* or *102a, 102b* may be obtained by molding or injection capable of forming a receptacle that can be reclosed where the small container containing the product and the applicator device are protected, perhaps by a reinforcing belt.

To obtain good tightness of the two half-shells, a coating of varnish can be deposited on the inside of the walls, so as to assure excellent conservation of the product, especially when the product contains serum or solvent.

The makeup set according to the invention can also be useful for testing nail polish. To this end, the applicator would no longer include a stiff bristle brush but instead a conventional softer bristle brush; the other characteristics of the package remain substantially unchanged. The material used to form the plastic sheet may for instance be a polyvinyl chloride/polyvinyl alcohol/polyethylene complex.

It will be understood that the exemplary embodiments described above are in no way limiting and may undergo any desirable modification without departing from the scope of the invention.

What is claimed is:

1. A makeup set, for testing a fluid cosmetic composition, comprising a package including an applicator comprising an element for holding in the hand and a device for distributing the composition to be tested, wherein said package has a chamber in which said distribution device is located and which is filled with the composition to be tested and said package comprising two sheets partially welded to one another, with a constricting zone formed between said sheets at a zone located between the element for being held in the hand and the distributor device of said applicator, and wherein said package has two separate portions, (13, 14; 113, 114), a first portion (13, 113) being capable of being opened and including a first, non-welded zone and a second zone where the sheets (*2a, 2b;* 102*a,* 102*b*) are connected to one another by a welded bead (6, 106) that defines a space (3, 103) containing the element (8, 108) for holding in the hand and which is connected to the second portion (14, 114) of the package, in which second portion (14, 114) the two sheets (*2a, 2b;* 102*a,* 102*b*) are welded in such a manner as to prevent their separation by manual action, the welding of said second portion (14; 114) defining said chamber, said chamber containing the distributor device (9, 109) of the applicator.

2. A makeup set as defined by claim 1, characterized in that the first portion (13) is capable of being opened by separation of the two sheets (*2a, 2b*) which form the package.

3. A makeup set as defined by claim 2, characterized in that the first zone of the first portion (13) of the package has at least one corner (11*a,* 11*b*) where one of the two sheets (*2a, 2b*) is cut to facilitate the separation of the two sheets (*2a, 2b*) in order to open said first portion (13).

4. A makeup set as defined by claim 1, characterized in that said portions are connected at a circular constriction zone, the first portion, in the space (103) containing the element (108) for holding in the hand, includes a bulge (17) substantially in the form of a bubble larger in diameter than the circular constriction zone (107) to which it is connected, and capable of comprising a folding zone preventing deformation from occurring at the level of the circular constriction zone (107).

5. A makeup set as defined by claim 4, characterized in that the welded bead (106) forms a recess (18) that surrounds the bulge (17) and connects it to the second portion (114) at a distance from the constriction zone (107).

6. A makeup set as defined by claim 1, characterized in that the set includes a pre-weakened zone (12, 112) located in the first portion (13, 113) in the vicinity of its junction with the second portion (14, 114).

7. A makeup set as defined by claim 6, characterized in that the pre-weakened zone (112) is arranged such as to permit the separation of the two portions (113, 114) by twisting substantially about the axis of the element (108) for holding in the hand.

8. A makeup set as defined by claim 7, characterized in that the pre-weakened zone (112) is created by two incisions (19, 20) provided on either side of the bulge in the form of the bubble (17).

9. A makeup set for testing a mascara composition as defined by claim 8, in that the distributor device (9) is a brush having bristles, and the element (8) for holding in the hand comprises the extension of the twisted metal wire that locks the bristles of said brush in place.

10. A makeup set as defined by claim 9, characterized in that the element (8, 108) for holding in the hand is coated with plastic material that is thermoshrinkable plastic material.

11. A makeup set for testing a nail polish composition as defined by claim 8, characterized in that the distributor device (9, 109) is a brush and that the element (8, 108) for holding in the hand comprises a rod to which the bristles of said brush are attached.

12. A makeup set as defined by claim 11, characterized in the sheets comprising the package are sheets of plastic material.

13. A makeup set as defined by claim 11, characterized in that the sheets (*2a, 2b;* 102*a,* 102*b*) which form the package comprise a polymer selected from the group comprising polyvinyl chloride, polyvinyl chloride/polyvinylidine chloride complexes, polyester/ polyethylene complexes, polyvinyl chloride/polyvinyl alcohol/polyethylene complexes, and polyacrylonitrile /polyethylene complexes.

14. A makeup set as defined by claim 12, characterized in that at least one of the sheets (*2a, 2b;* 102*a,* 102*b*) from which the package is made is metallized.

15. A small plate (15) grouping a plurality of makeup sets defined by claims 1 or 14, characterized in that the packages are disposed side by side and separated from one another by a perforated separation line.

16. A makeup set as defined in claim 12 wherein at least one of the sheets is a plastic/aluminum complex.

17. A makeup set as defined by claim 11, wherein the package sheets are thermoformable plastic material.

18. A makeup set as defined by claim 11, wherein the package sheets are metal capable of being covered with plastic material.

* * * * *